United States Patent [19]

Eschenko et al.

[11] Patent Number: 4,500,282

[45] Date of Patent: Feb. 19, 1985

[54] BURNER GUIDE VANE DEVICE

[76] Inventors: Vladislav Y. Eschenko, Tashavtomash-2, 15, kv. 20; Irsali K. Musaev, kvartal 19, 10, kv. 39; Zakhidzhan S. Talibdzhanov, kvartal TS 17/18, 7, kv. 26, all of Tashkent; Viktor A. Leonov, ulitsa Alishera Navoi, 21/6, kv. 55, Dushanbe; Anatoly D. Bobrov, ulitsa Dimitrova, 5, kv. 132, Ulyanovsk; Efim I. Kirovsky, Chilanzar, kvartal 13, 3, kv. 62, Tashkent; Vladimir A. Gritsenko, Kara-Kamysh, 2/4, 35, kv. 48, Tashkent; Alexandr V. Golovanov, massiv Junus-Abad B-1, 63, kv. 73, Tashkent, all of U.S.S.R.

[21] Appl. No.: 267,477

[22] Filed: May 27, 1981

[51] Int. Cl.[3] ..... F23M 9/00

[52] U.S. Cl. ..... 431/184; 239/402.5

[58] Field of Search ..... 431/184, 185, 188; 239/402.5, 403, 405; 98/110, 111, 113

[56] References Cited

U.S. PATENT DOCUMENTS 2,464,791 3/1949 Bonvillian et al. ..... 431/184 X
2,818,109 12/1957 Voorheis ..... 431/184
3,367,385 2/1968 Dunn ..... 431/184 X

FOREIGN PATENT DOCUMENTS 251745 9/1969 U.S.S.R. ..... 431/184
314037 11/1971 U.S.S.R. ..... 431/184
375447 3/1973 U.S.S.R. .

OTHER PUBLICATIONS

"Gas Burner Devices" by Yu. V. Ivanov, NEDRA Publishers, Moscow, 1972.
"Gas-Blast Burner Devices" by R. B. Akhmetov, NEDRA Publishers, Moscow, 1970.

*Primary Examiner*—Randall L. Green
*Attorney, Agent, or Firm*—Fleit, Jacobson, Cohn & Price

[57] ABSTRACT

The disclosed burner guide vane device includes a housing with an inlet pipe and a cylindrical swirl chamber having equidimensional gas inlet ports symmetrically arranged therein in diametral opposition to each other; pivotable vanes or gates are located centrally of these inlet ports on axles to which they are attached by their central portions, the vanes having their radius of curvature 1.2 to 1.6 times greater than that of the swirl chamber.

4 Claims, 6 Drawing Figures

II
II
1
7
6
4
5
2
8
10

A
B
7
5
8
1
10
3
II
13
11
9
III
6
2
8
8
14
12

A
B
7
5
1
C
17
10
3
12
18
8
8
2
6
16
11
15
9

BURNER GUIDE VANE DEVICE

FIELD OF INVENTION

The present invention relates to burner arrangements of fuel combustion apparatus, and more particularly it relates to guide vane devices of the burners, intended to shape the dynamic structure of the annual flows of gaseous fluids.

INDUSTRIAL APPLICABILITY

The invention can be utilized in burners of fuel combustion apparatus, particularly, of boiler installations, where the aerodynamics and burning character of the flame are to be adjusted to optimize the heat exchange process.

The invention can be utilized to utmost effectiveness in burner arrangements adapted to be fired with various fuels having significantly different heat-yielding and physical characteristics, e.g. with blast-furnaces gas and fuel oil.

BACKGROUND OF THE INVENTION

The trend of expanding the range of the kinds of fuel employed for solving energy problems has become characteristic of many countries, particularly, of industrially developed ones.

There are known guide vane devices of burner arrangements, intended to shape swirling annular flows with a predetermined intensity of the swirl, a predetermined velocity field and a predetermined turbulence degree. Each one of these guide vane devices is characterized by parameters of its action upon the flow, pressure loss, velocity field non-uniformity across the outlet section and the character of this field.

In their turn, these parameters are associated with the geometric dimensions of the components of the guide vane device.

At present, guide vane devices are utilized in combustion arrangements as the means of intensifying the combustion process.

There is known a guide vane device of a burner of the simple tangential type (see, for example, "Burner Devices" by Y. V. Ivanov, in Russian, NEDRA Publishers, Moscow, 1972). The device shapes a flow with a swirl intensity defined by the relationship of the geometric dimensions (the width and length of the feed pipe, the degree of tangentiality of the flow introduced into the swirl chamber, etc.).

By shaping the swirling flow in accordance with the abovelisted dimensions, with moderate pressure loss values ($\epsilon=3$ to 5), there is formed by the guide vane device a turbulized flame with the zone of back flows adjacent to the axis, stabilizing the combustion process.

A drawback of the guide vane device of this type is the fixed relationship between the flow characteristics and the geometric dimensions. Besides, the single-side introduction of the flow into the swirl chamber inflicts considerable velocity losses in the areas adjoining the walls, whereby the swirling flow is characterized by significant non-uniformity about the circumference, while the swirl efficiency is inadequate.

There is further known a scroll type guide vane device with a flap-type gate or vane for adjusting the inlet width and the degree of tangentiality of the flow entering the swirl chamber (see, for example, "Blower-Type Gas Burner Devices" by D. N. Akhmedov, NEDRA Publishers, in Russian, Leningrad, 1970).

The incorporation of the flap-type vane in the inlet pipe enables to control the intensity of the swirling of the annular flow within a considerable range, and thus to vary the corresponding characteristics of the flame.

A drawback of the guide vane device of this type is likewise its considerable velocity field non-uniformity, resulting from the single-side introduction of the flow into the swirl chamber.

Moreover, the swirl devices of both abovementioned types are not free from a common drawback, i.e. the impossibility to alter the swirling direction.

There is still further known a guide vane device of a burner providing for controlling both the direction and intensity of the swirling (see, for example, the SU Inventor's Certificate No. 375,447; Int. Cl. F 23 d 17/00, dated 1971).

This guide vane device comprises a cylindrical swirl chamber with equidimensional symmetrically arranged gas inlet ports provided with pivotable vanes or gates. The axles of the pivotable vanes or gates extend along the respective generatrices of the swirl chamber, parallel with the longitudinal axis thereof.

In this device, by varying the position of the pivotable vanes within a broad range, it is possible to vary the width of the gas inlet slits defined by the edges of the vanes and the stationary members of the guide device. This, in its turn, enables to control the intensity of the swirl within a considerable range, as well as the swirl direction. The control range of the flame characteristics of burner arrangements provided with guide devices of this kind is sufficiently wide, with moderate pressure head losses.

A disadvantage of this known guide vane device, however, is the pronounced velocity field non-uniformity and insufficiently effective swirling attained with acceptable head losses.

This can be explained by concentrated introduction of the flow into the swirl chamber, and by the existense of local resistances in the areas where the pivotable vanes adjoin the swirl chamber.

DISCLOSURE OF THE INVENTION

It is an object of the present invention to expand the control range and to enhance the swirl efficiency.

It is another object of the present invention to step up the degree of utilization of the flow energy and to shape an annular flow with the predetermined swirl direction and intensity.

It is still another object of the present invention to enhance the reliability of the vane-pivoting operation and to reduce the efforts required for adjustment-wise pivoting of the vanes.

These objects are attained in a guide vane device of a burner, comprising a housing with an inlet pipe and a cylindrical swirl chamber having equidimensional gas inlet ports symmetrically arranged therein, and pivotable vanes on axles extending along the generatrix of the swirl chamber, in which device, in accordance with the invention, the pivotable vanes have their radii of curvature 1.2 to 1.6 times greater than the radius of curvature of the swirl chamber, the vanes being mounted by their central portions on the axles arranged centrally of the gas inlet ports situated in diametral opposition to each other.

It is expedient, in order to further expand the control range, to have each pivotable vane of a built-up structure, with its component parts being pivotable independently of each other.

This enables to set the predetermined ratios of the slit ducts open for introduction of the flow into the swirl chamber and to control the degree of their opening, thus controlling the swirl intensity within a considerable range, as well as the swirl direction.

BRIEF DESCRIPTION OF THE DRAWINGS

The invention will be further described in connection with its embodiments, with reference being made to the accompanying drawings, wherein.

DETAILED DESCRIPTION OF THE INVENTION

Figures 1, 2, 3:
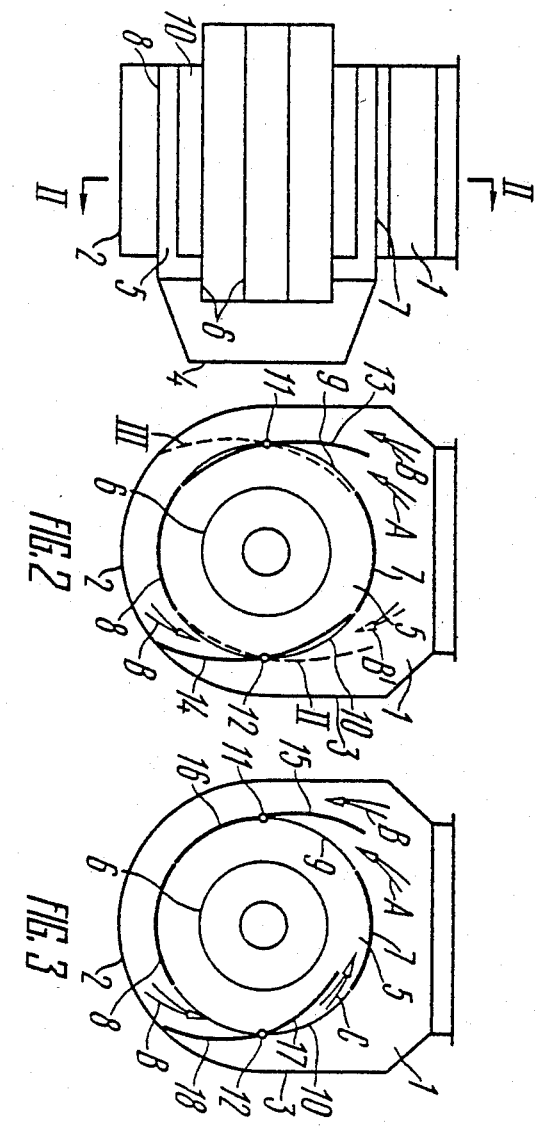
FIG. 1 is a longitudinally sectional view of a burner guide vane device in accordance with the invention.
FIG. 2 is a sectional view taken on line II—II of FIG. 1.
FIGS. 3, 4 and 5 illustrate various examples of setting the pivotable vanes, each one being made up of two parts pivotable independently of each other about the common axis.

The guide vane device of a burner, embodying the invention, comprises a housing 1 (FIGS. 1 and 2) shaped as a semicylinder 2 conjugated with either an individual rectangular-section box 3 (the feed or inlet pipe), or else with a box common to an array of burners (this modification is not shown in the appended drawings). Accommodated within the housing 1 coaxially with the cut-off section 4 (FIG. 1) of the outlet of the burner is a cylindrical swirl chamber 5 (FIGS. 1, 2, 3, 4 and 5) having mounted therein, coaxially therewith, communication means 6 of the guide device of the burner, e.g. the fuel-air mixture tube, a tube accommodating a fuel oil nozzle, and the like. The cylindrical swirl chamber 5 has stationary arcuate segments 7 and 8 of which the respective edges define inlet ports 9 and 10. Arranged centrally of these equidimensional inlet ports 9 and 10 which are situated in diametral opposition to each other are the respective axles 11 and 12 of pivotable gates or vanes 13 and 14 (FIG. 2), the axles 11 and 12 extending along the respective generatrices of the swirl chamber 5, and the vanes 13 and 14 having their radius of curvature 1.2 to 1.6 times greater than the radius of curvature of the stationary segments 7 and 8 of the swirl chamber 5.

There can be at least two alternative structures of the pivotable vanes 13 and 14. In the embodiment illustrated in FIG. 2 the vanes 13 and 14 are integral ones and have their central portions secured on the axles 11 and 12, respectively.

To further extend the range of adjusting or controlling the air-structure of the flow and to enhance the swirling efficiency, it is expedient to have the pivotable vanes made up each of two parts 15, 16 and 17, 18 (FIGS. 3, 4 and 5) mounted on the same respective axles 11 and 12 for independent rotation of the parts 15 and 16, 17 and 18.

Figure 6:
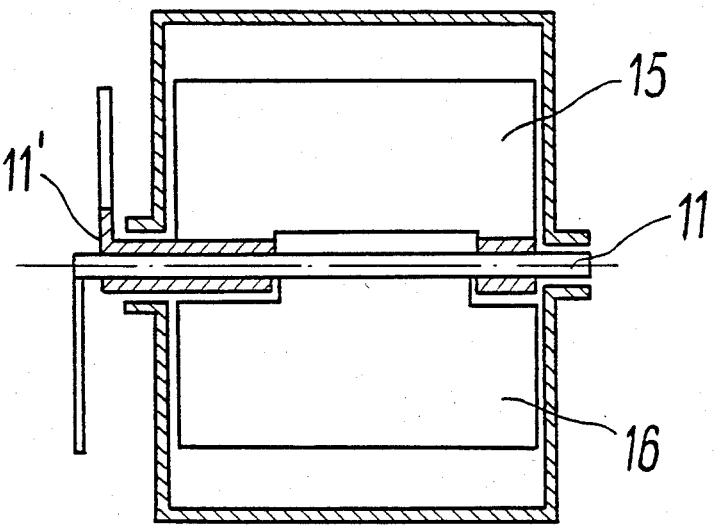
FIG. 6 is a side view taken along the line IV—IV shown in FIG. 5.

The part 15 is shown in FIG. 6, with part 16 being pivotably mounted independently of each other around a common axis. Part 15 is secured to an intrinsic axle 11'. Axle 11' concentrically surrounds independently operable axle 11 to which part 16 is secured. Parts 17 and 18 are similarly arranged.

Let us consider the operation of the burner guide vane device.

The gas flow is supplied into the housing 1 (FIGS. 1 and 2) via its rectangular-section box 3, to be divided at the edge of the open vane 13 into two parts (indicated with arrows A and B in FIG. 2). One part of the flow, moving along the arrow A, enters the cylindrical swirl chamber 5 via the rectangular-section duct defined by the respective edges of the pivotable vane 13 and the stationary segment 7 of the cylindrical swirl chamber 5, whereas the other part of the flow, moving along the arrow B, passes intermediate the wall of the box 3 and the convex side of the pivotable gate 13, whereafter it advances intermediate the cylindrical wall of the housing 1, the pivotable gate 13 and the stationary segment 8, to enter the swirl chamber 5 via a similar duct defined by the respective edges of the pivotable gate 14 and the segment 8 (FIG. 2).

The degree of tangentiality and the width of the inlet ducts of the flows along the arrows A and B depend on the actual construction parameters of the guide vane device of the burner. By pivoting the vane 14 (FIG. 2) on its axle 12 into the position II (shown with a broken line), the swirl efficiency can be reduced by creating an opposition flow (along arrow B') in the cylindrical swirl chamber 5, which reduces the major moment of momentum, while leaving the value of the momentum itself intact. With the flows indicated with arrows A and B' equalling each other, the swirl is reduced to zero.

To alter the swirl direction, the vane 14 is to be set to the position II, while the vane 13 is to be pivoted on its axle 11 into a position symmetrical with the position of the vane 14, i.e. into position III (shown with a broken line).

With the radius of curvature of the vanes 13 and 14 being 1.2 to 1.6 times greater than the radius of curvature of the stationary surfaces of the segments 7 and 8 of the cylindrical swirl chamber 5, there takes place break-off-free mode of motion of the flows in the swirl chamber 5, and local flow resistances or pressure losses are avoided. The swirl intensity is significant since the deconcentrated tangential introduction of the flow into the swirl chamber 5 provides for a high value of the tangential component of the velocity thereinside, which, with one and the same momentum, enhances the intensity of swirling. With the gas inlet ports 9 and 10 being arranged symmetrically and in diametral opposition, there is ensured essential equality of the parameters of the flows along arrows A and B, which enables to attain an annular flow with a small degree of the velocity field non-uniformity, and that at high swirl values.

The arrangement of the axles 11 and 12 of the pivotable vanes 13 and 14 centrally of the gas inlet ports 9 and 10 enables to counterbalance the dynamic and gravity forces applied to the pivotable vanes 13 and 14 relative to their respective axles.

Figure 4:
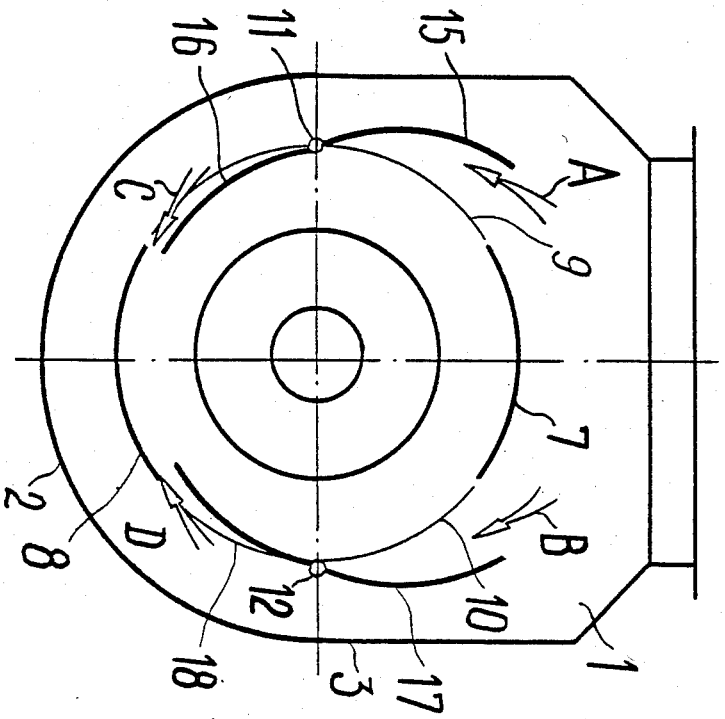
Figure 5:
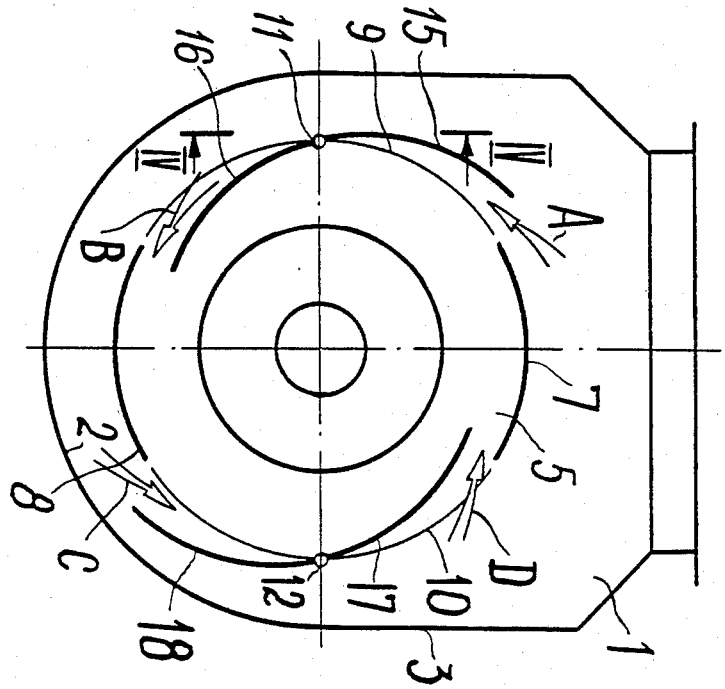

Further extension of the swirl intensity control range can be attained by having each pivotable vane of a built-up structure, e.g. of two parts 15 and 16, 17 and 18 (FIGS. 3, 4 and 5).

It can be seen in FIG. 3 that by pivoting the part 17 of the vane, there is ensured additional introduction into the swirl chamber 5 of the third air flow (indicated with the arrow C), intermediate the concave surface of the segment 7 and the convex surface of the part 17 of the vane. The high degree of tangentiality of the introduction of the flow along the arrow C would enhance the swirl intensity while reducing the pressure loss, owing to the additional introduction of the flow into the swirl chamber 5 reducing the intensity of the drop of the tangential component of the velocity to a smaller degree than this value is affected by the reduction of the velocity of flow introduction.

With each vane being made up of two parts, there can be set the fourth path of introduction of the flow into the swirl chamber 5. In the once-through mode (FIG. 4), the effective swirl practically equals zero. This enables to have smaller velocity field non-uniformity of the flow than with integral vanes 13 and 14 (FIG. 2). The flows along the inlet arrows A and B (FIG. 4), owing to the dynamic interaction with the internal walls of the parts 15, 16 and 17, 18 of the vanes, and the flows along the arrows C and D additionally deflect the resulting flow toward the inlet, i.e. the box 3.

The setting of the parts 15, 16 and 17, 18 of the vanes to the positions shown in FIG. 5 provides for the maximum swirl intensity, owing to the high degree of tangentiality of the introduction of the flows (arrows A, B, C, D in FIG. 5), particularly, of the flows along arrows B and D. Furthermore, owing to the deflection of the flows toward the centre by the concave surfaces of the parts 16 and 17 of the vanes, there is attained redistribution of the radial values of the density of the swirling flow in the flow chamber 5, which additionally enhances the efficiency of utilization of the pressure head built up upstream of the guide vane device of the burner.

The disclosed structure of the guide vane device, incorporable in burners both with individual supply of the gaseous media and with common feed boxes, provides for a significant range of control of the aerodynamical parameters of the annular flow, and that with high efficiency of utilization of the pressure head and reduced adjustment-wise efforts.

What we claim is:

1. A burner guide vane device for use with a burner nozzle comprising: a housing having an inlet pipe and an outlet pipe; a cylindrical swirl chamber defined by said housing; equidimensional spaced stationary segments positioned within said housing forming gas inlet ports arranged symmetrically in diametrical opposition to each other; and pivotable vane units mounted at their central portions on respective axles positioned centrally of said gas inlet ports each said pivotable vane units being comprised of two parts, each part of each vane unit being independently pivotable around its said respective axle along an inner edge of each said part.

2. A burner guide vane device as set forth in claim 1, wherein the radius of curvature of said pivotable vane units is 1.2 to 1.6 times greater than the radius of curvature of the stationary segments.

3. A burner guide vane device for use with a burner nozzle comprising: a housing having an inlet pipe and an outlet pipe; a cylindrical swirl chamber defined by said housing; spaced stationary segments positioned within said housing forming gas inlet ports arranged in diametrical opposition to each other; and pivotable vane units mounted at their central portions on respective axles positioned centrally of said gas inlet ports each said pivotable vane unit being comprised of two parts each part of each vane unit being independently pivotable around its said respective axle along an inner edge of each said part.

4. A burner guide vane device as set forth in claim 3, wherein the radius of curvature of said pivotable vane units is 1.2 to 1.6 times greater than the radius of curvature of the stationary segments.

* * * * *